United States Patent [19]

Thro

[11] Patent Number: 4,667,945

[45] Date of Patent: May 26, 1987

[54] DEVICE FOR LOCATING AND ORIENTING OBJECTS

[75] Inventor: Dennis E. Thro, Lancaster, Pa.

[73] Assignee: RCA Corporation, Princeton, N.J.

[21] Appl. No.: 924,732

[22] Filed: Oct. 30, 1986

[51] Int. Cl.[4] ..... B25B 1/08

[52] U.S. Cl. ..... 269/234; 269/237; 269/287; 269/908; 269/305

[58] Field of Search ..... 279/1 L; 269/237-239, 269/234, 303, 133, 305, 908, 287, 289 MR

[56] References Cited

U.S. PATENT DOCUMENTS 3,032,331 5/1962 Doty et al. ..... 269/237
3,385,592 5/1968 Hasell et al. ..... 269/133
3,802,688 4/1974 Rolke et al. ..... 269/237
3,927,873 12/1975 Chambers ..... 269/237
4,621,797 11/1986 Ziegenfuss ..... 269/908

*Primary Examiner*—Robert C. Watson
*Attorney, Agent, or Firm*—E. M. Whitacre; D. H. Irlbeck; L. L. Hallacher

[57] ABSTRACT

A device for locating and orienting objects at a precise location includes a lever pivoted to a fixed support. The lever supports a first urging member arranged at a first preselected distance from the pivot axis. A second urging member is pivoted to the lever at a second predetermined distance from the pivot axis. Pivoting of the lever causes the urging members to urge the object into the desired precise location and orientation.

12 Claims, 4 Drawing Figures

DEVICE FOR LOCATING AND ORIENTING OBJECTS

BACKGROUND

This invention relates generally to object locating and orienting devices and particularly to such a device for orienting and locating kinescopes at a precise location.

There is a trend in industry to automate the production and testing of various articles of manufacture. This is particularly true of the manufacture of kinescopes for television receivers and monitors. Typically, late in the manufacturing process, the kinescopes are tested to verify that the various electrical and operational characteristics are in conformity with the manufacturing specifications. For such testing, the kinescopes are placed upon a conveyor with their screens in the same vertical orientations as when the kinescopes are in receivers. The necks of the kinescopes, thus, extend horizontally when their viewing screens are vertical. The conveyor is incremented to various positions where various tests are performed. To facilitate the automation of the testing process, the kinescope necks must be oriented and located at a precise location so that test sockets can automatically be applied to the neck of the tube. Also, kinescopes are produced in several sizes and, typically, various sizes of kinescopes are randomly run along the same production line. Accordingly, various size kinescopes are randomly conveyed along the production and testing lines to the various testing positions. For these reasons, there is a need for a device for precisely orienting and locating kinescopes of various sizes at a precise location. The present invention fulfills this need.

SUMMARY

A device for locating and orienting an object at a precise location includes a stationary support member arranged at a preselected location from the precise location. A lever member is pivotably coupled to a pivot axis of the support member. A first object urging member is located a first preselected distance from the pivot axis and urges the object in a first direction toward the precise location. A slidable ramp is pivotably coupled to the lever member a second preselected distance from the pivot axis. A second object urging member is arranged to slide on the ramp and is pivotably coupled to the stationary support member for urging the object toward the precise location in a second direction, substantially normal to the first direction.

DETAILED DESCRIPTION

Figure 1:
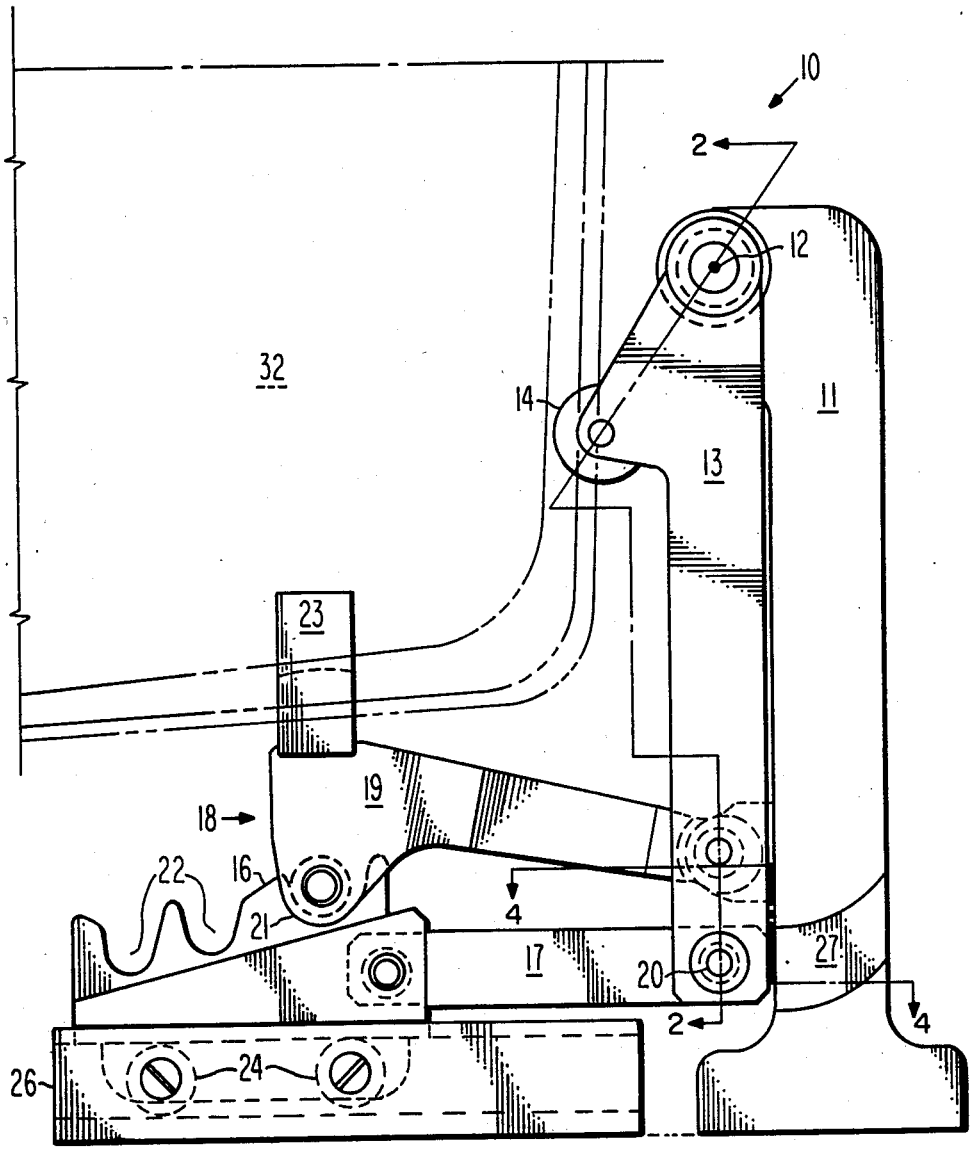
FIG. 1 is a front view of a preferred embodiment.

In FIG. 1, the locating and orienting device 10 includes a stationary support 11. A pivot axis 12 is arranged in the proximity of one end of the stationary support 11. A lever 13 is pivotably coupled to the stationary support 11 at the pivot axis 12. A first urging member 14, in the form of a roller, is rotatably coupled to the lever 13 a preselected distance from the pivot axis 12. A slidable ramp 16 is pivotably coupled to one end of a connector link 17, the other end of which is pivotably coupled to the free end of the pivotable lever 13 by a pin 20. A second urging member 18 includes an elongated member 19, one end of which is pivotably coupled to the stationary support 11. The free end of the elongated member 19 includes a rounded portion 21, which rides in detent indentations 22, which are provided in the surface of the ramp 16. An L-shaped object carrying member 23 is affixed to the elongated member 19 immediately above the rounded portion 21. The detent indentations 22 are dimensioned and spaced along the ramp 16 to position the L-shaped member 23 at selected heights. A plurality of rollers 24 are affixed to the bottom surface of the slidable ramp 16. The rollers are constrained in a guide 26. Because the connector link 17 is pivotably coupled to the slidable ramp 16 and to the lever 13, the slidable ramp 16 is free to move horizontally in response to pivoting of the lever 13 on the pivot axis 12.

Figure 2:
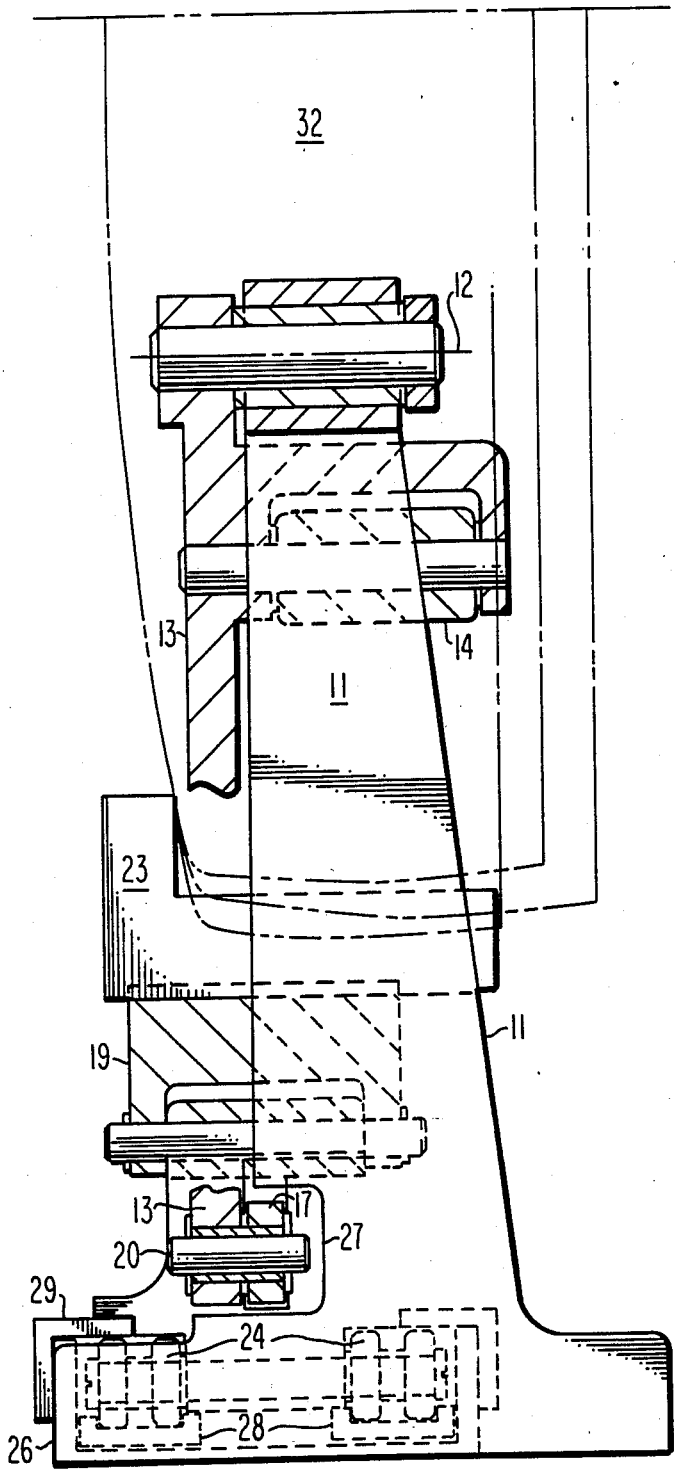
FIG. 2 is a side view of a preferred embodiment, partially in cross section along the line 2—2 of FIG. 1.

In FIG. 2, the lever 13 (which is shown partially broken away for convenience of illustration) and the stationary support 11 are arranged side by side. The stationary support 11 includes a slot 27 to accommodate the end of the connector link 17 and the pin 20. Accordingly, as the lever 13 pivots counterclockwise in response to the reception of an object, the end of the connector link 17 can enter into the slot 27 without interference. The rollers 24 ride in channel shaped members 28 and are constrained at the top by angular members 29 to assure a linear movement of the slidable ramp 16.

Figure 3:
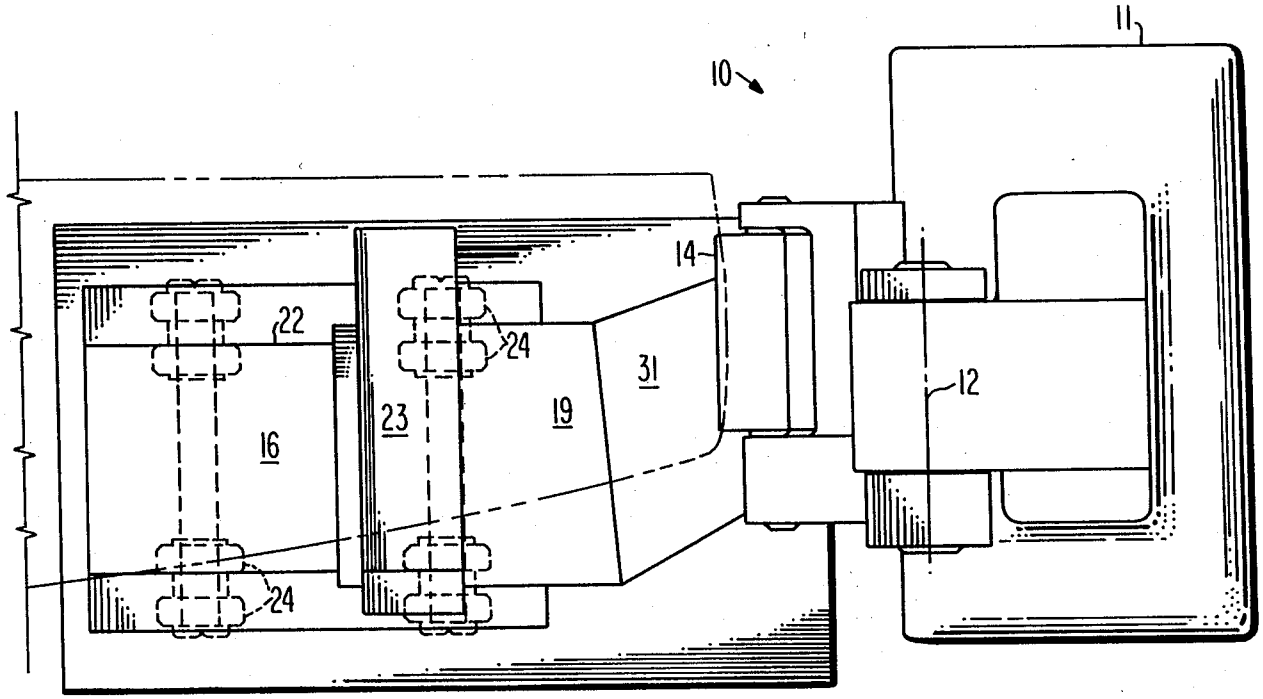
FIG. 3 is a top view of the preferred embodiment of FIG. 1.

In FIG. 3 the rollers 24 are arranged in pairs to provide a stable, strong support for the slidable ramp 16. The elongated member 19 has an angularly disposed portion 31 to permit the member to be simultaneously pivotably attached to the stationary support 11 and to the slidable ramp 16 without interferring with the lever 13. The restraining channels 28 and angular members 29 are eliminated from FIG. 3 for simplicity.

Figure 4:
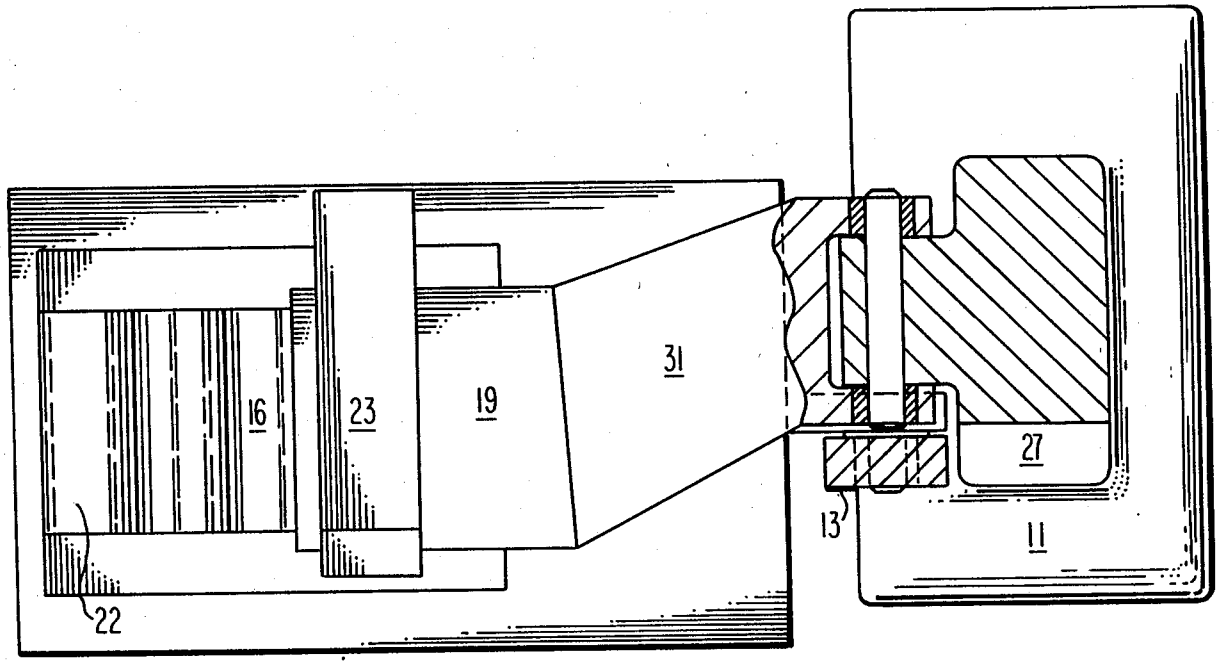
FIG. 4 is a top view of the preferred embodiment of FIG. 1, partially in cross section along the line 4—4 of FIG. 1.

FIG. 4 shows how the elongated member 19 is pivotably coupled to the stationary support 11. The angularly disposed portion 31 narrows toward the pivot point to aid in avoiding interference with the lever 13. FIG. 4 also shows how the detent indentations 22 extend across the surface of the slidable ramp 16.

In operation, a substantially square object, such as a kinescope 32, one quarter of which is shown in phantom in FIGS. 1 and 2, is lowered into the locating and orienting device 10. One side of the object engages the first urging member 14 and the lever 13 pivots counterclockwise resulting in the slidable ramp 16 sliding horizontally toward the stationary support 11. The curved portion 21 of the elongated member 19 slides along the surface of the ramp 16 into engagement with one of the detent indentations 22. Larger objects cause a greater rotation of lever 13 than smaller objects and the curved end 21 of the elongated member 19 moves further down the ramp 16. When the object 32 is completely lowered into the device 10, the urging member 14 engages one side of the object and the L-shaped urging member 23 engages an adjacent side of the object so that the two urging members span one corner of the object. The distance between the center line of the urging member 14 and the pivot axis 12 is selected to be a first preselected distance. Also, the distance between the pivot axis 12 and the center of the pin 20, where the ramp 16 is pivotably coupled to the ramp 13, is selected to be a second preselected distance. These distances are selected so that both the urging members 14 and 23 engage adjacent sides of the object being positioned. To simultaneously support the elongated member 19 on the surface of the ramp 16 and the L-shaped object carrying member 23 against the object for all sizes of objects, the positions of the detent indentations 22 are spaced along the ramp at intervals determined by the dimensions of the objects being tested. The depths of the indentations 22 also are determined by the dimensions of the objects to be tested. The required spacing and depths can be determined by triangulation by one skilled in the art. Thus, when kinescopes are being positioned the indentations 22 are spaced to assure that several sizes will be firmly held at the proper height. If desired, the elongated member 19 can be spring biased to cause the member 19 to rotate upwardly out of the indentations 22 when no object is in place. This aids the lifting of the rounded portion 21 out of the indentations. Objects of several sizes can be used with the invention, the object initially engages the urging member 14 to cause counterclockwise rotation of the lever 13. The larger the object the further the lever pivots and the further down the ramp the urging member 18 moves to set the needed height of the support 23. It should be understood that both bottom corners of the object are supported, so that identical devices span the two lower corners of the object being positioned and oriented. Because of the precise construction of the device, the locations of the urging members 14 and 15 with respect to the pivot axis 12, and the selected spacing and depths of the indentations 22, a plurality of sizes of objects can be accurately located and oriented with the inventive device and when the objects being positioned are kinescopes the necks of several sizes of kinescopes are oriented and located at a precise, desired location.

What is claimed is:

1. A device for locating and orienting an object at a precise location comprising:

a stationary support member arranged at a preselected location from said precise location, and arranged to extend along a side of said object;

a lever member pivotably coupled to a pivot axis of said support member;

a first object urging member, located a first preselected distance from said pivot axis, for urging said object in a first direction toward said precise location;

a slidable ramp pivotably coupled to said lever member a second preselected distance from said pivot axis; and a second object urging member, arranged to slide on said ramp and pivotably coupled to said stationary support member for urging said object toward said precise location in a second direction, substantially normal to said first direction.

2. The device of claim 1 wherein said object is substantially square and said first and second object urging members are arranged to urge adjacent sides of said object.

3. The device of claim 2 wherein said first and second preselected distances are selected in a selected ratio.

4. The device of claim 3 wherein said ramp includes detent indentations for engaging said second object urging member at selected positions.

5. The device of claim 4 wherein said first object urging member is a rotatable roller.

6. The device of claim 5 wherein said second object urging member is an elongated member having one end pivoted to said stationary support member, and includes a rounded portion for engaging said ramp, and also includes an object carrying member for carrying said object arranged in the proximity of said rounded portion.

7. The device of claim 6 wherein said ramp is constrained to move linearily as said lever member pivots on said stationary support member.

8. The device of claim 2 wherein said ramp includes detent indentations for engaging said second object urging member at selected positions.

9. The device of claim 8 wherein said detent indentations are spaced along said ramp and have depths in accordance with the dimensions of said objects.

10. The device of claim 9 wherein said first object urging member is a rotatable roller.

11. The device of claim 10 wherein said second object urging member is an elongated member having one end pivoted to said stationary support member, and includes a rounded portion for engaging said ramp, and also includes an object carrying member for carrying said object arranged in the proximity of said rounded portion.

12. The device of claim 11 wherein said ramp is constrained to move linearily as said lever member pivots on said stationary support member.

* * * * *